US009951424B2

(12) United States Patent
Huang

(10) Patent No.: US 9,951,424 B2
(45) Date of Patent: Apr. 24, 2018

(54) PLATING METHOD FOR PRINTED LAYER

(71) Applicant: HOEY CO., LTD., Taoyuan (TW)

(72) Inventor: Joseph Huang, Taoyuan (TW)

(73) Assignee: HOEY CO., LTD., Taoyuan (TW)

( * ) Notice: Subject to any disclaimer, the term of this patent is extended or adjusted under 35 U.S.C. 154(b) by 78 days.

(21) Appl. No.: 15/148,191

(22) Filed: May 6, 2016

(65) Prior Publication Data

US 2016/0355929 A1 Dec. 8, 2016

(30) Foreign Application Priority Data

Jun. 3, 2015 (TW) ..... 104117885 A
Jul. 28, 2015 (TW) ..... 104124314 A

(51) Int. Cl.

| | |
|---|---|
| ***C23C 18/16*** | (2006.01) |
| ***C23C 18/32*** | (2006.01) |
| ***C23C 18/18*** | (2006.01) |
| ***C23C 18/00*** | (2006.01) |
| ***C23C 18/31*** | (2006.01) |
| ***C23C 18/42*** | (2006.01) |
| ***C23C 18/38*** | (2006.01) |
| ***C25D 7/00*** | (2006.01) |
| ***C23C 18/54*** | (2006.01) |
| *C25D 3/12* | (2006.01) |

(52) U.S. Cl.

CPC ..... *C23C 18/32* (2013.01); *C23C 18/00* (2013.01); *C23C 18/16* (2013.01); *C23C 18/1603* (2013.01); *C23C 18/1607* (2013.01); *C23C 18/1608* (2013.01); *C23C 18/18* (2013.01); *C23C 18/1803* (2013.01); *C23C 18/1831* (2013.01); *C23C 18/1834* (2013.01); *C23C 18/31* (2013.01); *C23C 18/38* (2013.01); *C23C 18/42* (2013.01); *C23C 18/54* (2013.01); *C25D 7/00* (2013.01); *C25D 3/12* (2013.01)

(58) Field of Classification Search

CPC ..... C23C 18/00; C23C 18/16; C23C 18/1603; C23C 18/1607; C23C 18/1608; C23C 18/18; C23C 18/1803; C23C 18/1831; C23C 18/1834; C23C 18/31; C23C 18/32; C23C 18/38; C23C 18/42

See application file for complete search history.

(56) References Cited

U.S. PATENT DOCUMENTS 4,966,671 A * 10/1990 Nylander ..... G01N 27/3272 204/415
5,286,922 A * 2/1994 Curtiss ..... H01L 35/008 174/112
6,468,672 B1 * 10/2002 Donovan ..... C25D 5/14 205/169

FOREIGN PATENT DOCUMENTS

DE 102011050722 A1 * 12/2012
JP 02-014258 A * 1/1990
JP 2006-169349 A * 12/2004
KR 1020050081413 A * 8/2005

* cited by examiner

*Primary Examiner* — William P Fletcher, III
(74) *Attorney, Agent, or Firm* — Guice Patents PLLC

(57) ABSTRACT

A plating method includes: providing a work piece which is metal or non-metal; forming a printed layer on a predetermined region of a surface of the work piece through printing electrical conductive material on the predetermined region; forming a plated layer through plating the printed layer and the surface of the work piece.

19 Claims, 11 Drawing Sheets

A

PLATING METHOD FOR PRINTED LAYER

BACKGROUND OF THE INVENTION

Field of the Invention

The invention relates to a plating method for a printed layer, and more particularly to plating method forming a printed layer on a predetermined region of a surface of a work piece through printing electrical conductive material on the predetermined region and forming a plated layer through plating the printed layer and the surface of the work piece to prevent the printed layer from falling off.

Description of the Related Art

Plating is a common industrial process to beautify surfaces of a metal product. However, surfaces of plated metal products usually have monotonous metallic color, and thus they cannot satisfy aesthetical requirement. For aesthetical requirement or advertisement, some texts or figures are sometimes printed on the plated metal product. Therefore, a printing process is performed after the plating process.

In a conventional process, surfaces of metal work pieces are plated and a printed layer is afterwards formed on the plated surfaces through ink printing. The printed layer protrudes from the plated layer and is thus easily damaged or scratched off by a hard object or a foreign body.

In another conventional process, a printed layer is formed on surfaces of metal work pieces through ink printing before the metal work piece are plated. In such a process, the metal work piece may oxidize in the printing step before the plating step. Since the oxidation is not easily observed by eyes, is often causes a high defect rate. Even the oxidized product is processed by anti-oxidant, the printed layer still easily falls off during the plating process.

In addition to the drawbacks described above, products manufactured by the conventional process often have monotonous texts or figures.

BRIEF SUMMARY OF THE INVENTION

An object of the invention is to provide a plating method to form a plating layer protecting a printed layer and preventing the printed layer from falling off.

Another object of the invention is to provide a plating method making the printed layer to have a special emboss effect different the print layer formed by the conventional plating method.

Another object of the invention is to form a protective layer which looks like a surface formed by diamond pieces. The protective layer can prevent the printed layer from falling off.

The invention provides a plating method for a printed layer. The plating method in accordance with an exemplary embodiment of the invention includes: providing a work piece which is metal or non-metal; forming a printed layer on a predetermined region of a surface of the work piece through printing electrical conductive material on the predetermined region; forming a plated layer through plating the printed layer and the surface of the work piece. A metal plating layer is formed on the work piece to serve as a protective layer. Preferably, the protective layer is a semi-bright nickel plating layer so that the work piece has a smooth surface.

In another exemplary embodiment, the electrical conductive material is electrical conductive paint.

In yet another exemplary embodiment, the electrical conductive material is fluorescent paint.

In another exemplary embodiment, the electrical conductive material is silver electrical conductive paint.

In yet another exemplary embodiment, the electrical conductive material is copper electrical conductive paint.

In another exemplary embodiment, the electrical conductive material is nickel electrical conductive paint or electrical conductive carbon.

The plating method in accordance with another exemplary embodiment of the invention includes: providing a work piece; forming a printed layer on a predetermined region of a surface of the work piece through printing a mixture of electrical conductive material and metal particles or electrical conductive particles on the predetermined region; forming a plated layer through plating the printed layer and the surface of the work piece.

In another exemplary embodiment, the plating method further includes: pre-immersing the printed layer to form a displacement layer on the printed layer.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
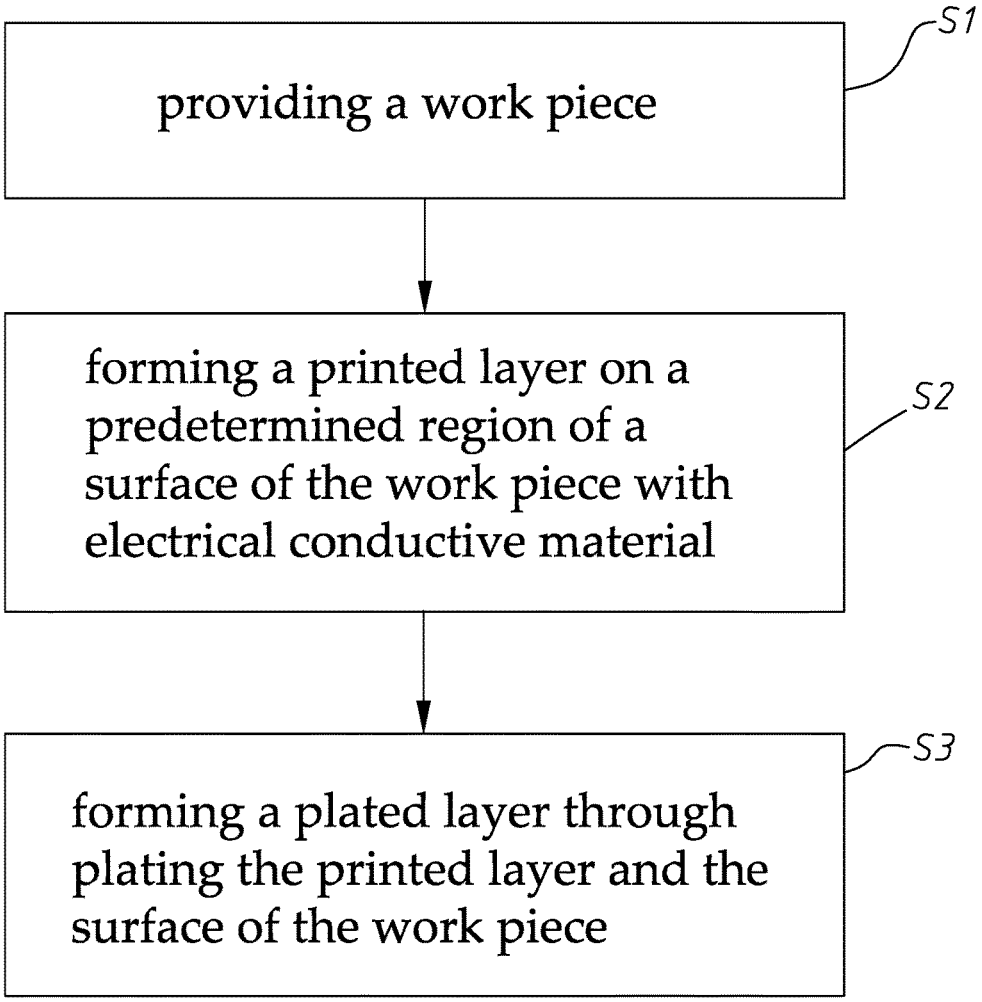
FIG. 1 is a flow chart of an embodiment of a plating method of the invention.
Figure 2:
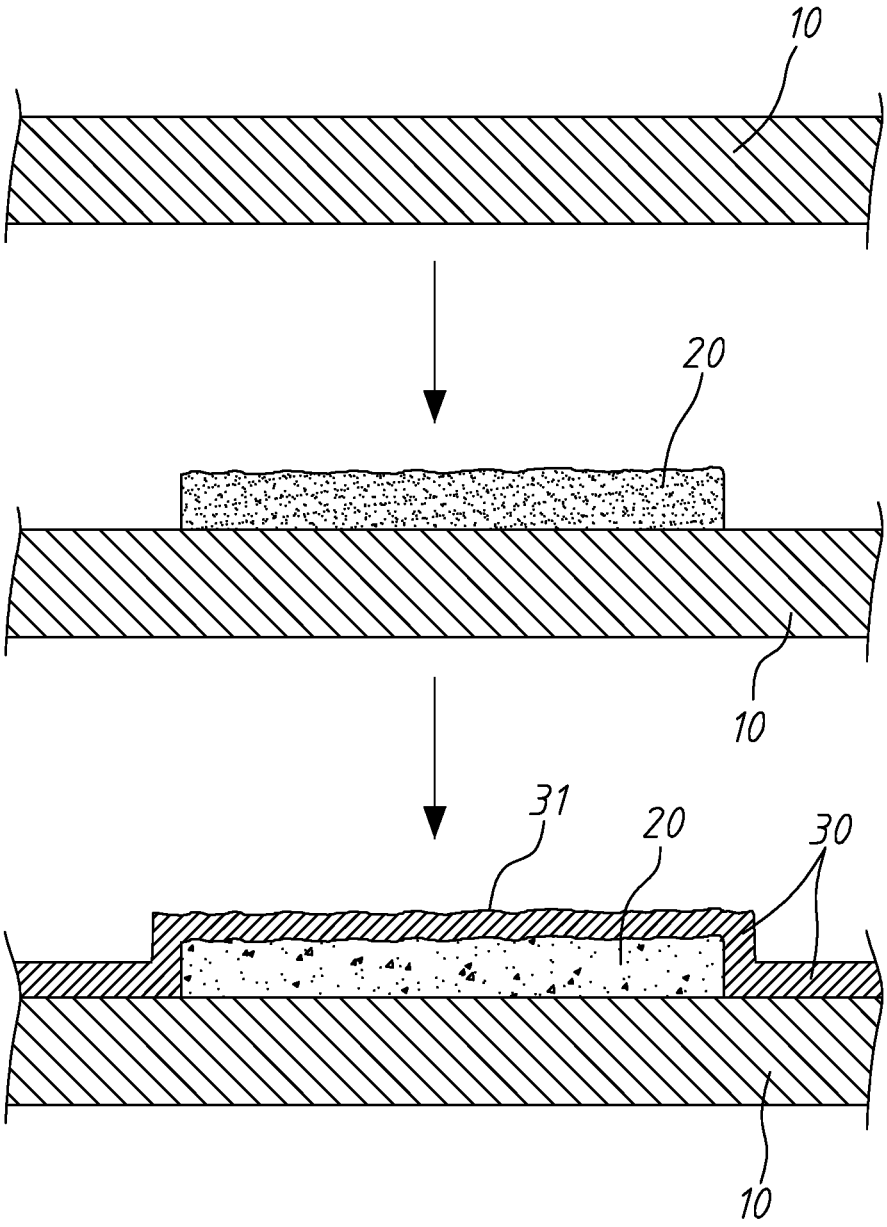
FIG. 2 depicts a manufacturing process of a plated product made by the plating method of FIG. 1.

Referring to FIGS. 1 and 2, a plating method of the invention includes the following steps: S1: providing a work piece 10 which is metal or non-metal; S2: forming a printed layer 20 on a predetermined region of a surface of the work piece 10 through printing electrical conductive material on the predetermined region; and S3: forming a plated layer 30 through plating the printed layer 20 and the surface of the work piece 10.

The electrical conductive material is electrical conductive paint or fluorescent paint. The electrical conductive paint is silver electrical conductive paint including silver particles, copper electrical conductive paint including copper particles or nickel electrical conductive paint including nickel particles or electrical conductive carbon. The copper electrical conductive paint has a lower price than the silver electrical conductive paint. The nickel electrical conductive paint has a better electrical conductivity. The electrical conductive material is selected according to the texts or figures printed on the work piece.

Figure 3:
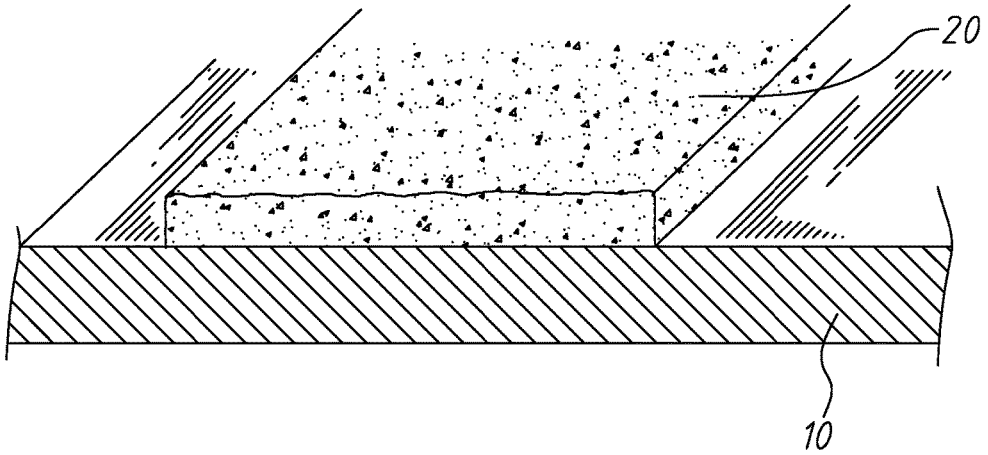
FIG. 3 depicts a printed layer formed on a work piece by the plating method of FIG. 1.
Figure 4:
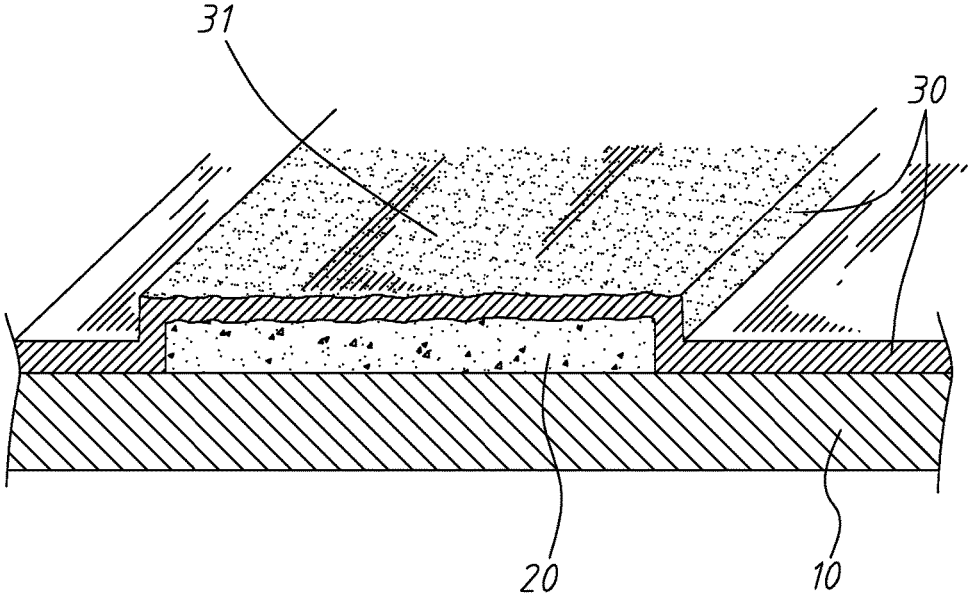
FIG. 4 depicts a plated layer formed on a work piece by the plating method of FIG. 3.

Referring to FIGS. 3 and 4, the printed layer 20 is formed on the predetermined region of a surface of the work piece 10 through printing electrical conductive material on the predetermined region. The plated layer 30 is formed through plating the printed layer 20 and the surface of the work piece 10. The plated layer 30 is coated on the surface of the work piece 10 so as to protect the surface of the work piece 10.

Figure 6:
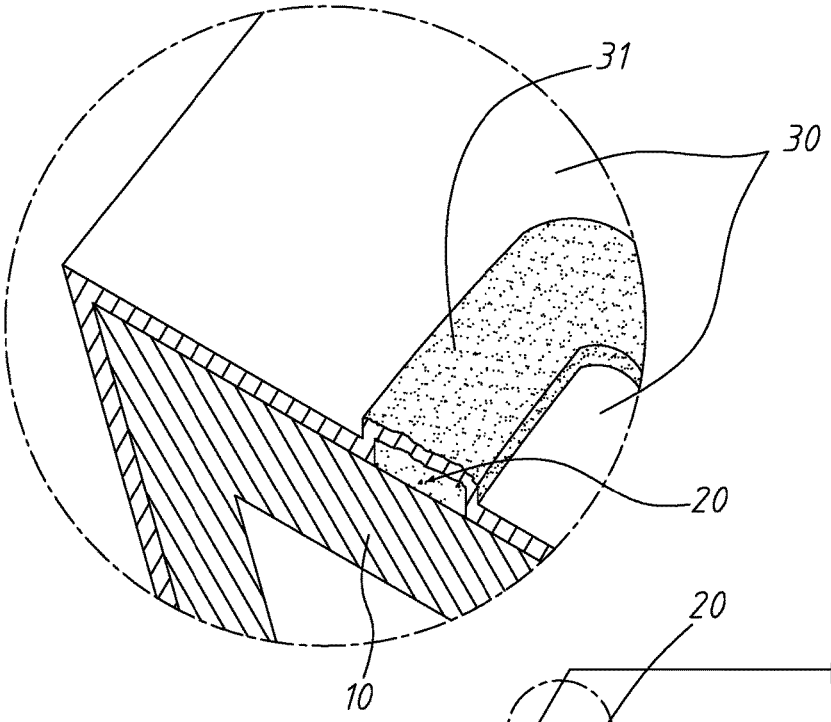
FIG. 6 is a partially enlarged view of the plated product of FIG. 5.
Figure 5:
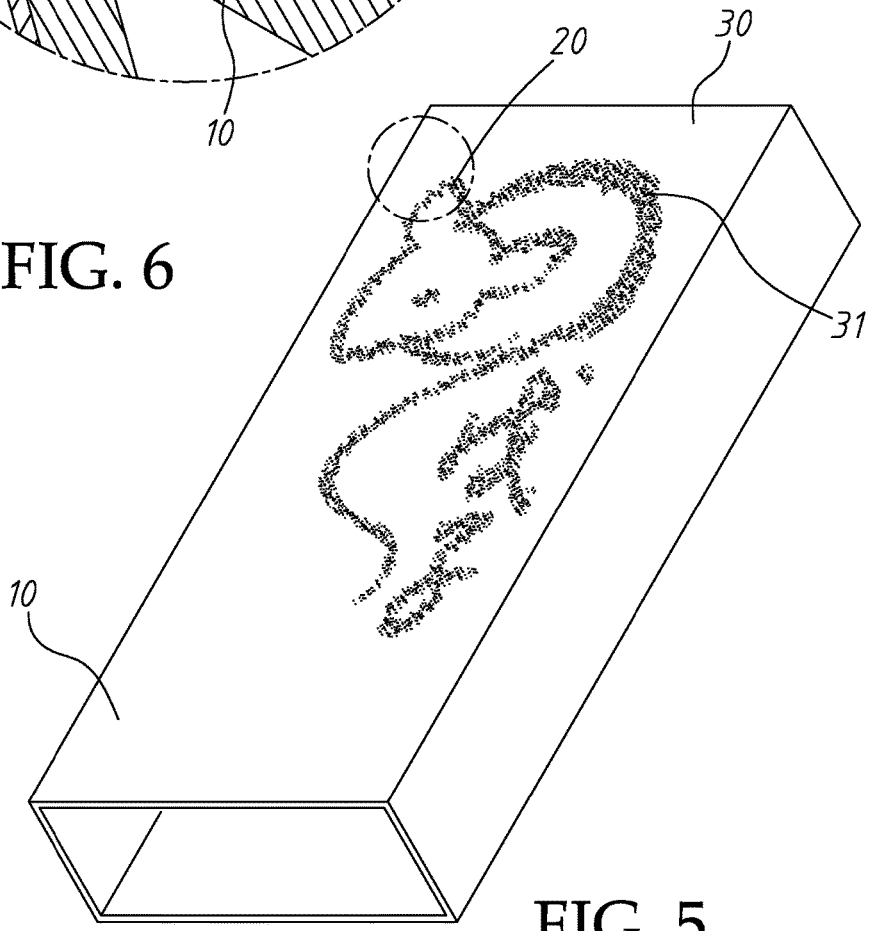
FIG. 5 is a schematic view of a plated product of the invention.

Referring to FIGS. 5 and 6, since the printed layer 20 is formed by printing electrical conductive material including metal particles on the work piece 10, when the plated layer 30 is formed on the printed layer 20 and the surface of the work piece 10, the plated surface 31 on the printed layer 20 is embossed and provides a matte effect. A metal plating layer is formed on the work piece 10 to serve as a protective layer 101. Preferably, the protective layer 101 is a semi-bright nickel plating layer so that the work piece 10 has a smooth surface.

Figure 7:
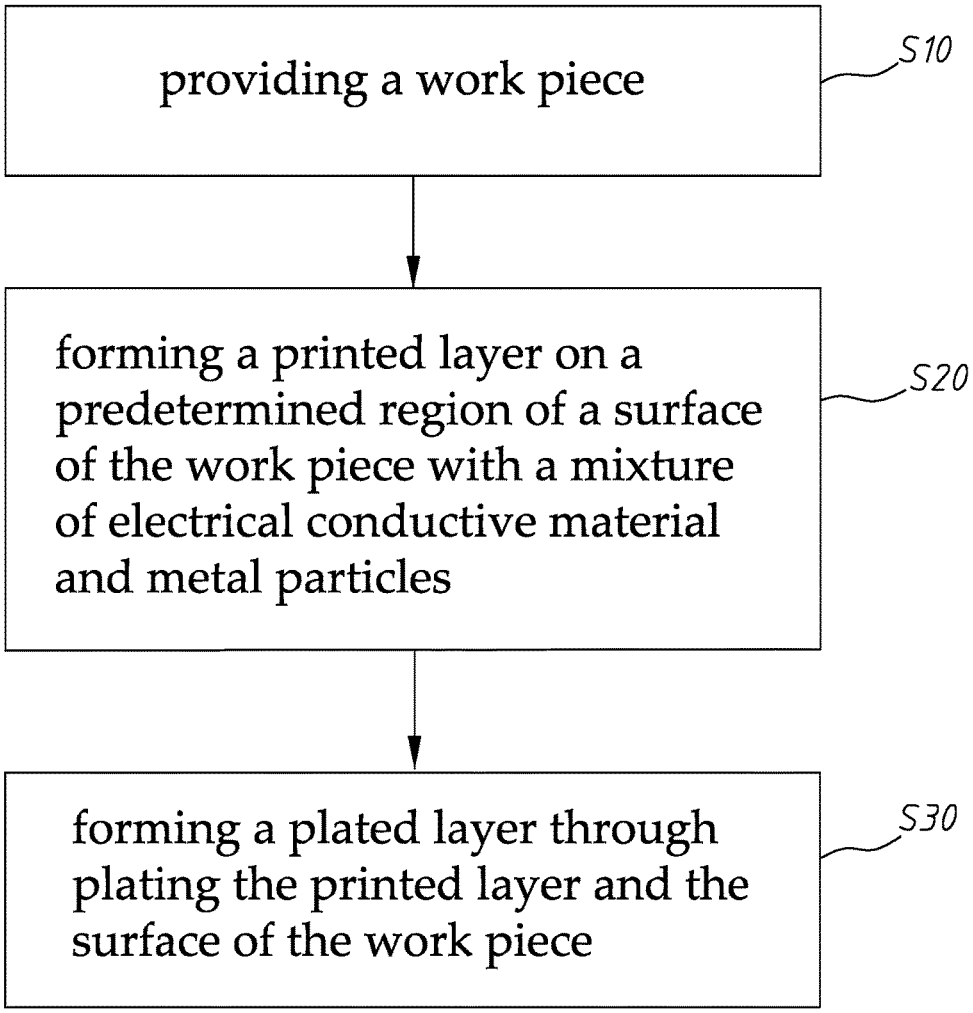
FIG. 7 is a flow chart of another embodiment of a plating method of the invention.
Figure 8:
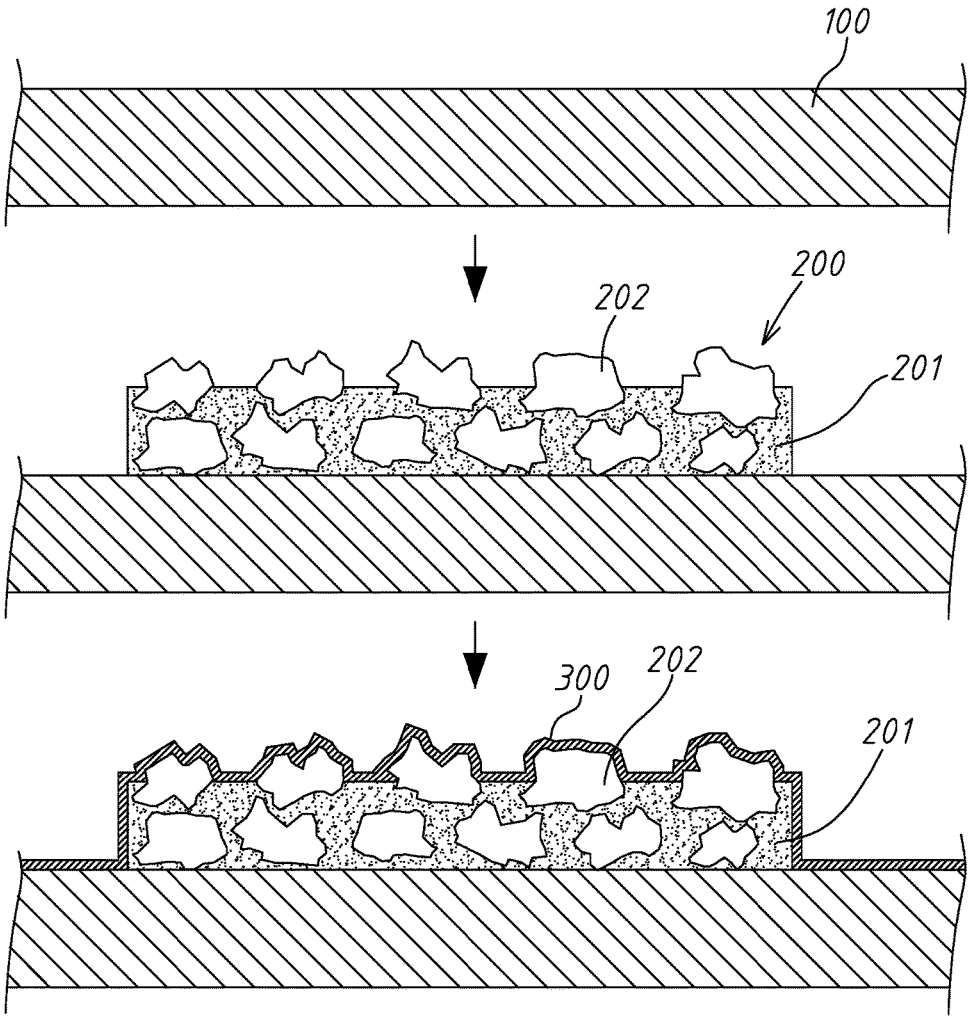
FIG. 8 depicts a manufacturing process of a plated product made by the plating method of FIG. 7.

Referring to FIG. 7 or 8, another embodiment of a plating method of the invention includes the following steps: S10: providing a work piece 100 which is metal or non-metal; S20: forming a printed layer 200 on a predetermined region of a surface of the work piece 100 through printing a mixture of electrical conductive material 201 and metal particles 202 or other electrical conductive particles on the predetermined region; and S30: forming a plated layer 300 through plating the printed layer 200 and the surface of the work piece 100.

Figure 9:
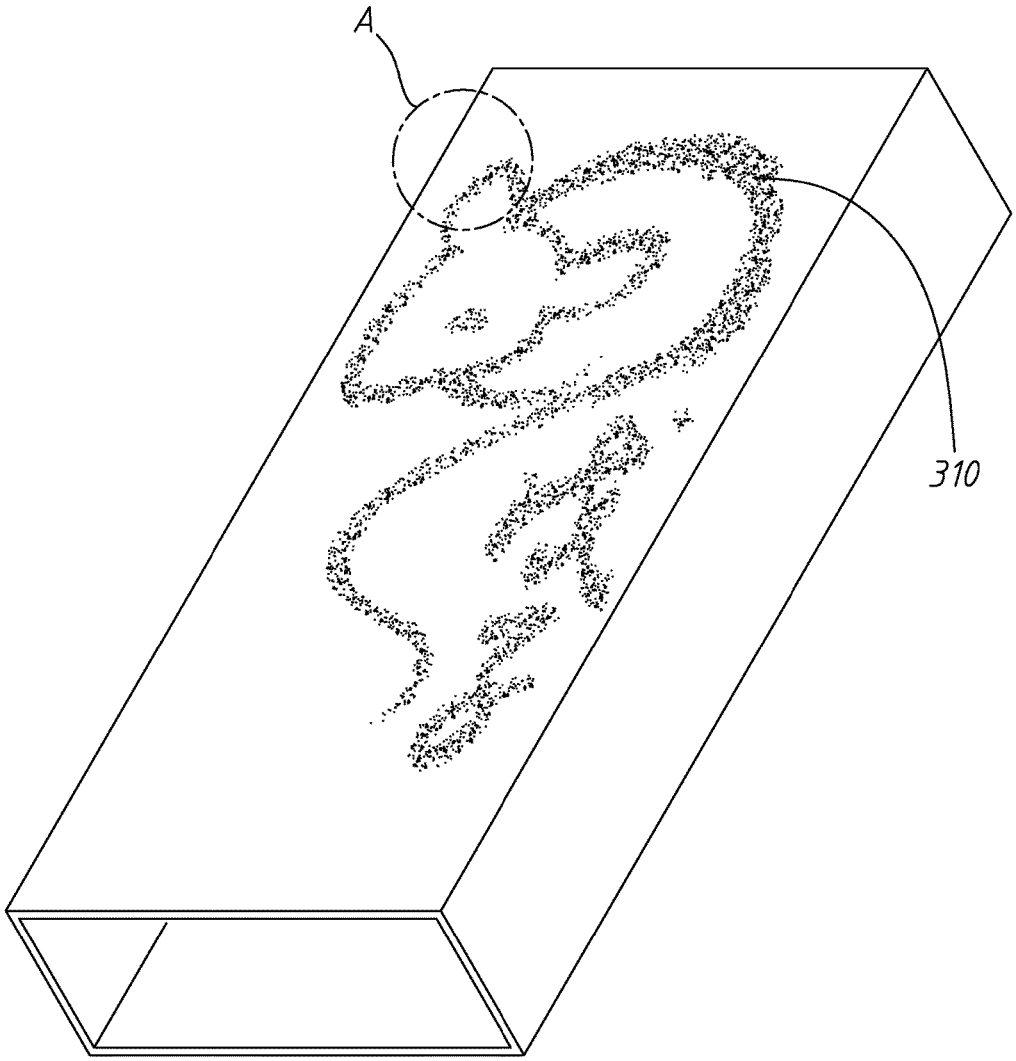
FIG. 9 a schematic view of a plated product manufactured by the plating method of FIG. 7.
Figure 10:
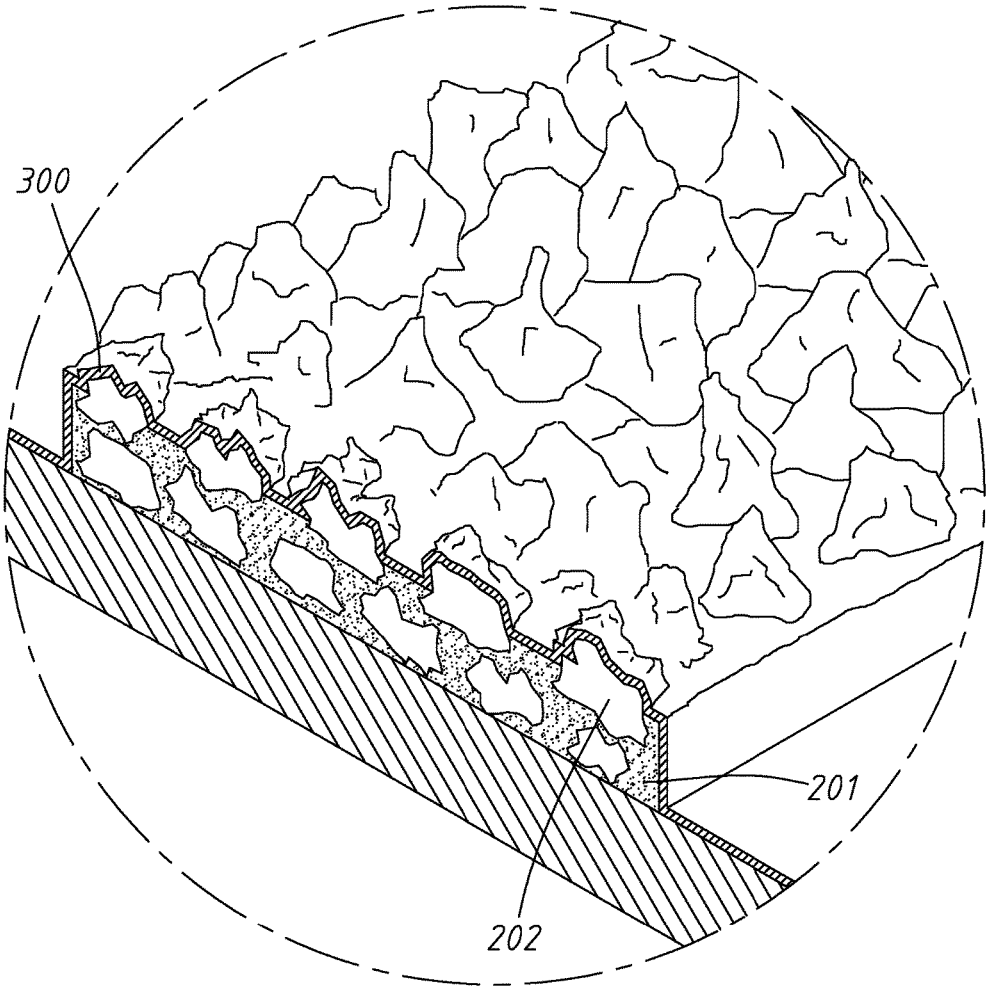
FIG. 10 is an enlarged view of portion A of FIG. 9.

Referring to FIGS. 9 and 10, since the printed layer 200 includes metal particles 202 mixed with the electrical conductive material 201, the plated surface 310 has a decoration effect just like the work piece 100 embedded with diamond pieces. In this embodiment, a metal plating layer is formed on the work piece 10 to serve as a protective layer 101. Preferably, the protective layer 101 is a semi-bright nickel plating layer so that the work piece 10 has a smooth surface.

Figure 11:
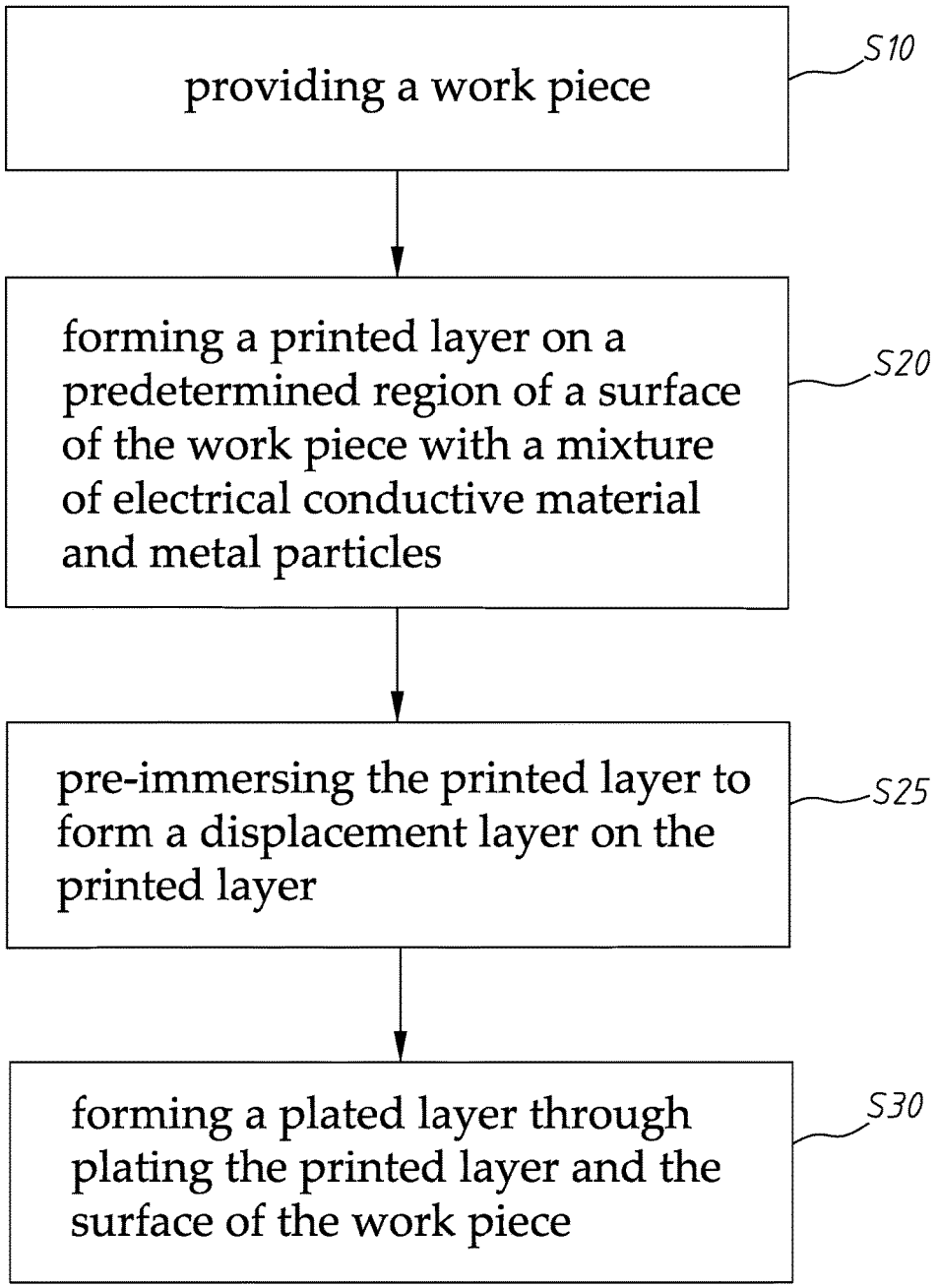
FIG. 11 is a flow chart of another embodiment of a plating method of the invention.
Figure 12:
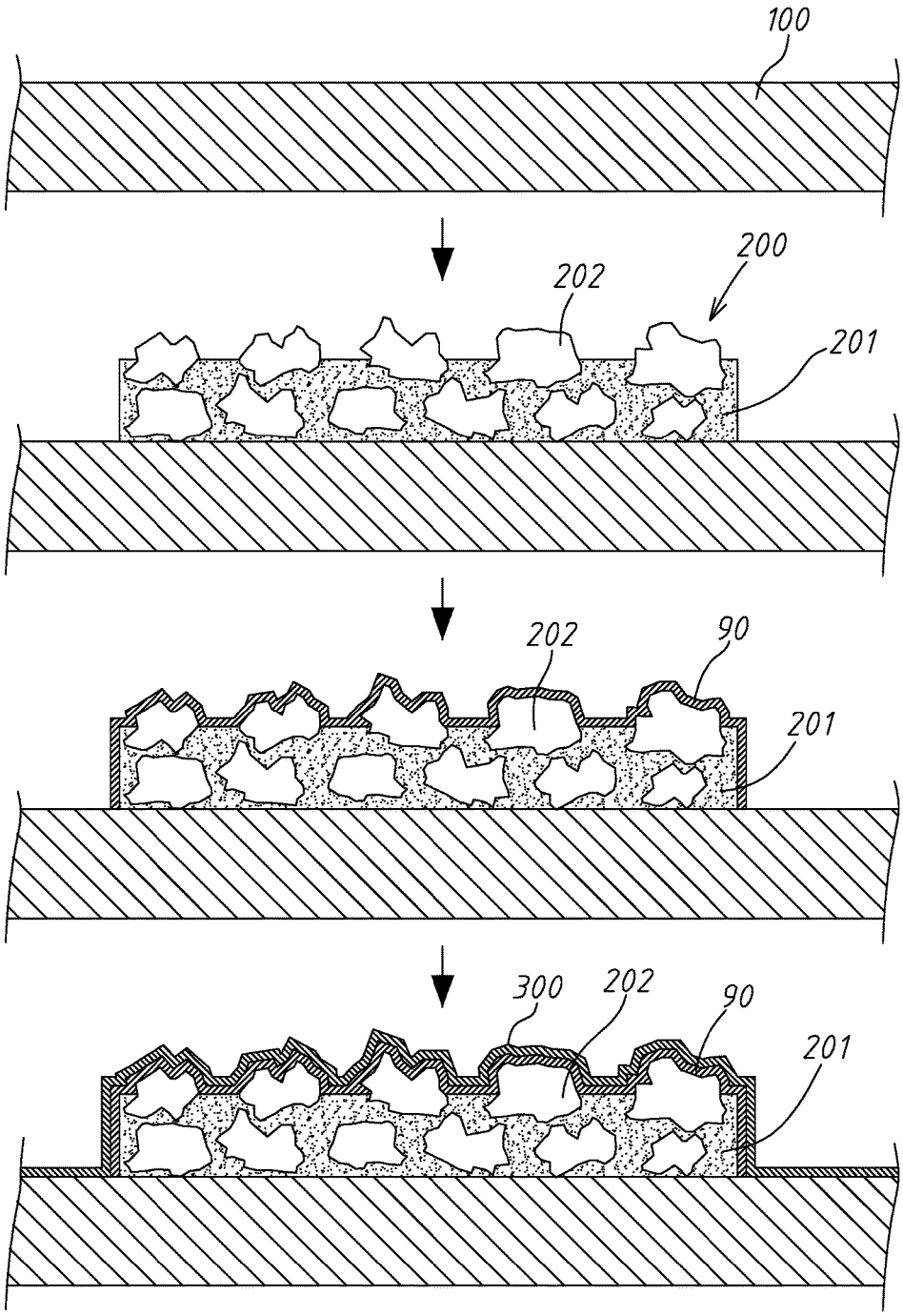
FIG. 12 depicts a manufacturing process of a plated product made by the plating method of FIG. 11.
Figure 13:
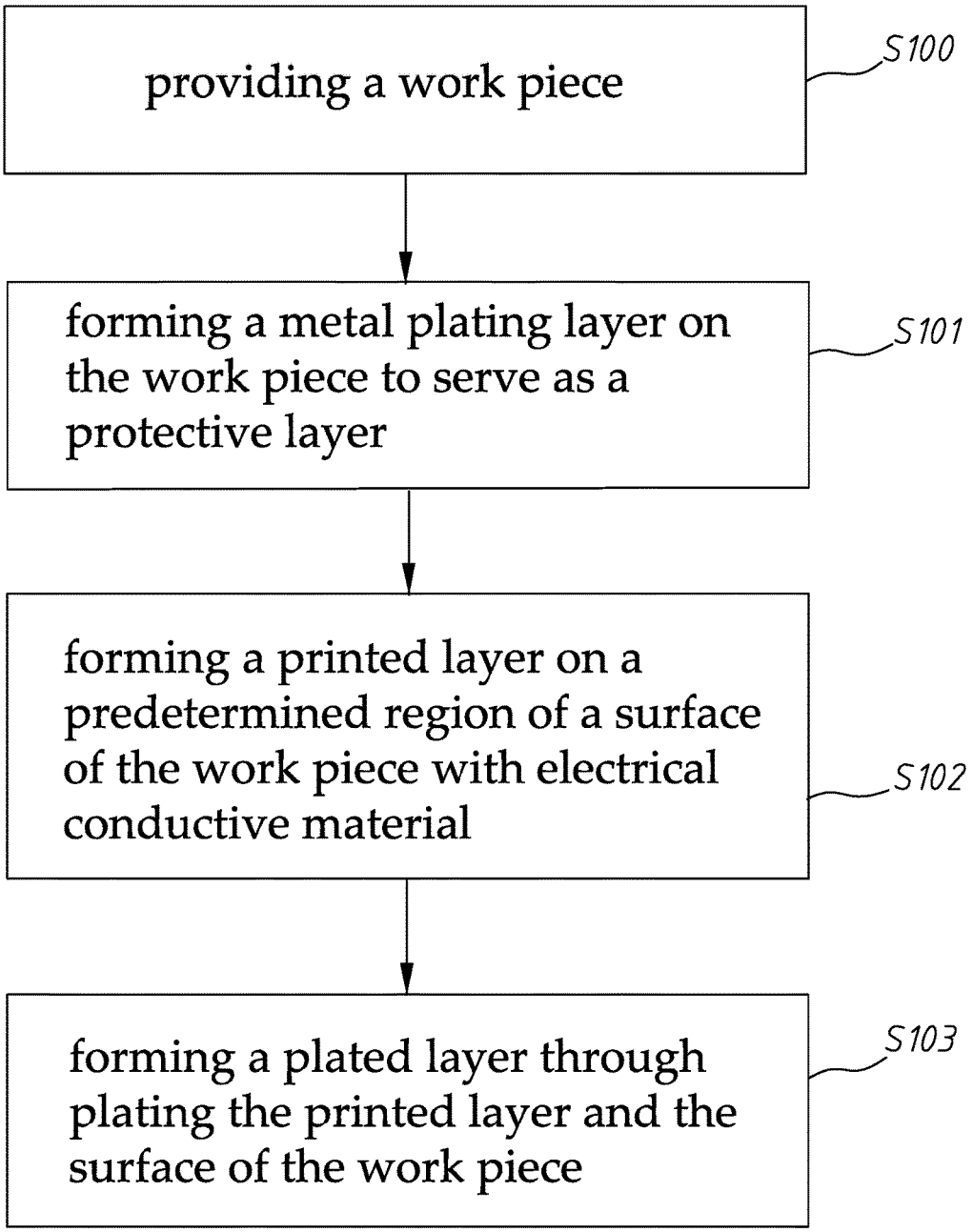
FIG. 13 is a flow chart of another embodiment of a plating method of the invention.

Referring to FIGS. 11 and 12, another embodiment of a plating method of another embodiment of the invention includes the following steps step: S10: providing a work piece 100 which is metal or non-metal; S20: forming a printed layer 200 on a predetermined region of a surface of the work piece 100 through printing a mixture of electrical conductive material 201 and metal particles 202 on the predetermined region; S25: pre-immersing the printed layer 200 to form a displacement layer 90 on the printed layer 200; and S30: forming a plated layer 300 through plating the printed layer 200 and the surface of the work piece 100. The displacement layer 90 allows the plated layer 300 attached to the printed layer 200 more tightly and prevents the plated layer 300 from falling off.

The plating method of the invention has the following advantages: the printed layer is formed by printing electrically conductive material, which speeds the plating process; the plated layer 30 protects the printed layer 20 and prevents the printed layer 20 from being scratched by hard object; a matte and embossed effect is provided by the printed layer 20; the printed layer and the plated layer are tightly attached to the work piece and has a shining effect like embedded with diamond pieces.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A plating method for a printed layer, comprising:
providing a work piece which is metal or non-metal;
forming a printed layer on a predetermined region of a surface of the work piece through printing electrical conductive material on the predetermined region;
forming a plated layer through plating the printed layer and the surface of the work piece, the plated layer covering and directly engaging all exposed surfaces of the printed layer and the surface of the work piece.

2. The plating method as claimed in claim 1, wherein the electrical conductive material is electrical conductive paint.

3. The plating method as claimed in claim 2, wherein the electrical conductive material is silver electrical conductive paint.

4. The plating method as claimed in claim 2, wherein the electrical conductive material is copper electrical conductive paint.

5. The plating method as claimed in claim 2, wherein the electrical conductive material is nickel electrical conductive paint.

6. The plating method as claimed in claim 1, wherein the electrical conductive material is fluorescent paint.

7. The plating method as claimed in claim 1 further comprising: forming a metal plating layer on the work piece to serve as a protective layer.

8. The plating method as claimed in claim 1, wherein the protective layer is a semi-bright nickel plating layer.

9. A plating method for a printed layer, comprising:
providing a work piece;
forming a printed layer on a predetermined region of a surface of the work piece through printing a mixture of electrical conductive material and metal particles on the predetermined region;
forming a plated layer through plating the printed layer and the surface of the work piece, the plated layer covering and directly engaging all exposed surfaces of the mixture of the electrical conductive material and the metal particles of the printed layer and the surface of the work piece.

10. The plating method as claimed in claim 9, wherein the electrically conductive material is electrical conductive paint.

11. The plating method as claimed in claim 10, wherein the electrical conductive paint is conductive carbon.

12. The plating method as claimed in claim 9, further comprising: pre-immersing the printed layer to form a displacement layer on the printed layer, the displacement layer being located between the exposed surfaces of the mixture of the electrical conductive material and the metal particles of the printed layer and the plate layer.

13. The plating method as claimed in claim 9 further comprising: forming a metal plating layer on the work piece to serve as a protective layer.

14. The plating method as claimed in claim 9, wherein the protective layer is a semi-bright nickel plating layer.

15. The plating method as claimed in claim 9, wherein the protective layer is a semi-bright nickel plating layer.

16. A plating method for a printed layer, comprising:

providing a work piece;

forming a printed layer on a predetermined region of a surface of the work piece through printing a mixture of electrical conductive material and electrical conductive particles on the predetermined region;

forming a plated layer through plating the printed layer and the surface of the work piece, the plated layer covering and directly engaging all exposed surfaces of the mixture of the electrical conductive material and the electrical conductive particles of the printed layer and the surface of the work piece.

17. The plating method as claimed in claim 16, wherein the electrically conductive material is electrical conductive paint.

18. The plating method as claimed in claim 16, wherein the electrical conductive paint is conductive carbon.

19. The plating method as claimed in claim 16 further comprising: forming a metal plating layer on the work piece to serve as a protective layer.

* * * * *